US006171562B1

(12) United States Patent
Paixao et al.

(10) Patent No.: US 6,171,562 B1
(45) **Date of Patent: *Jan. 9, 2001**

(54) PROCESS FOR THE EXTRACTION AND ELIMINATION OF DELETERIOUS MATERIAL FROM NATURAL MANGANESE DIOXIDE AND CONCENTRATE OF MANGANESE DIOXIDE OBTAINED BY SAID PROCESS

(75) Inventors: Jose Marcio Matta Machado Paixao; Josue Coelho Amaral, both of Minas Gerais (BR)

(73) Assignee: Companhia Vale Do Rio Doce, Minas Gerais (BR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/053,225

(22) Filed: Apr. 1, 1998

Related U.S. Application Data

(62) Division of application No. 08/946,257, filed on Oct. 7, 1997, which is a division of application No. 08/634,664, filed on Apr. 18, 1996, now abandoned, which is a continuation-in-part of application No. 08/351,584, filed on Dec. 7, 1994, now abandoned.

(30) Foreign Application Priority Data

Apr. 7, 1994 (BR) ..... 94/9401472

(51) Int. Cl.[7] ..... C22B 47/00

(52) U.S. Cl. ..... 423/49

(58) Field of Search ..... 423/49, 38, 39, 423/150.1, 150.4, 132, 202, DIG. 4

(56) References Cited

U.S. PATENT DOCUMENTS 4,089,928 * 5/1978 Foroglou ..... 423/49
4,150,091 * 4/1979 Peterson ..... 423/DIG. 4
4,872,909 * 10/1989 Allen et al. ..... 423/51

* cited by examiner

*Primary Examiner*—Steven Bos
(74) *Attorney, Agent, or Firm*—Helfgott & Karas, P.C.

(57) ABSTRACT

This invention relates to a new process for the extraction and elimination of deleterious material present in natural manganese dioxide (NMD), as well as in natural manganese dioxide obtained by such process. The process involves treating NMD with a HCl and water mixture in a reactor while stirring and heating the mixture. The heating temperature of the reactor is maintained in a predetermined range. The reactor is then fed with an amount of crushed NMD ore. A leaching reaction of said NMD ore with the HCl is produced by leaching for a period of time. Subsequently, the contents of the tank are filtered, washed and dried to recovery the concentrate of manganese dioxide substantially free of deleterious material.

7 Claims, 1 Drawing Sheet

Figure 1:
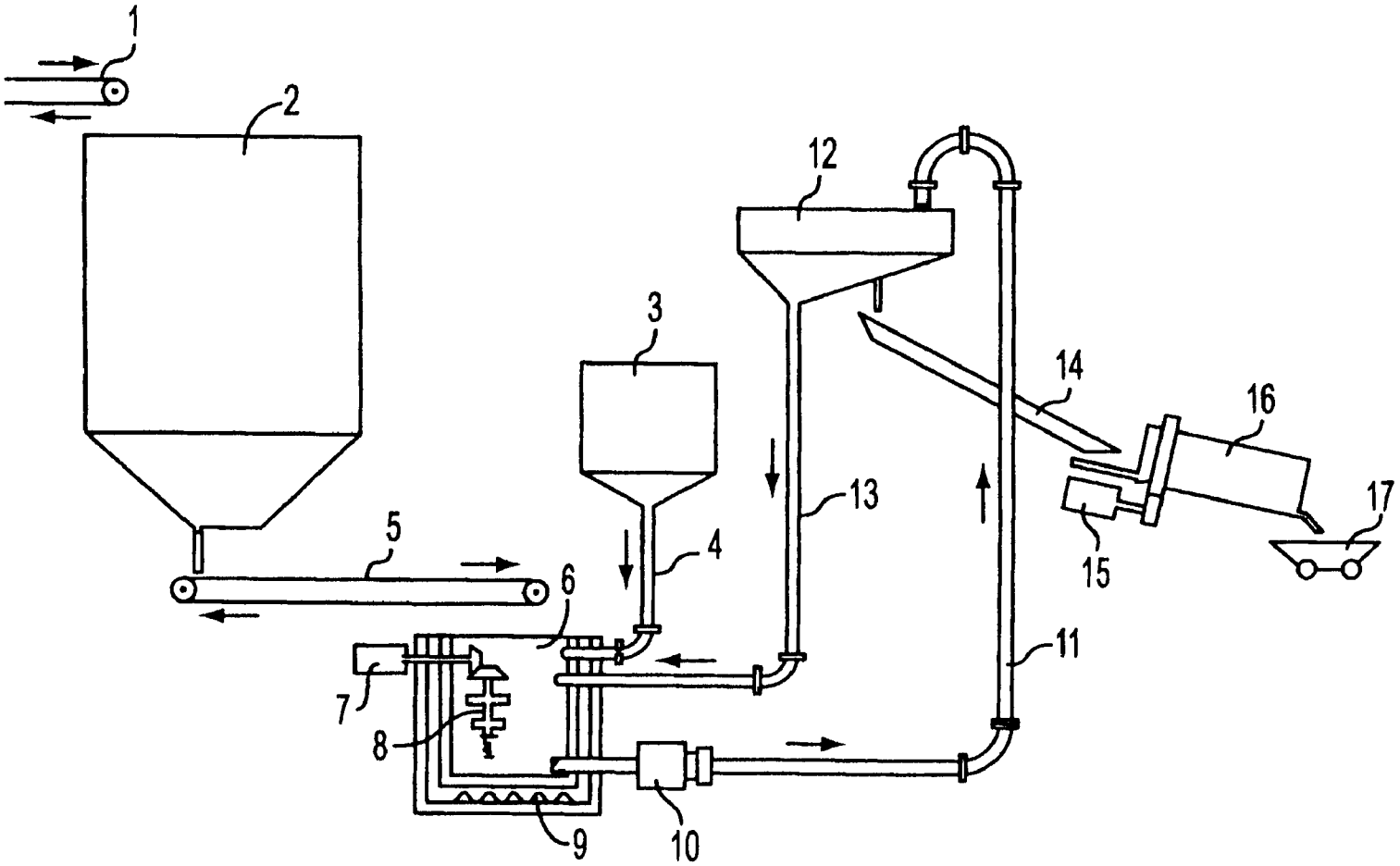

PROCESS FOR THE EXTRACTION AND ELIMINATION OF DELETERIOUS MATERIAL FROM NATURAL MANGANESE DIOXIDE AND CONCENTRATE OF MANGANESE DIOXIDE OBTAINED BY SAID PROCESS

RELATED PATENT APPLICATION

This application is a division of Ser. No. 08/946,257, filed Oct. 7, 1997, which is a division of Ser. No. 08/634,664, filed Apr. 18, 1996, abandoned, which is a continuation-in-part of U.S. patent application Ser. No. 08/351,584, filed Dec. 7, 1994, now abandoned.

BACKGROUND OF THE INVENTION

1. Field of the Invention

This invention is related to a process for the extraction and elimination of deleterious material present in natural manganese dioxide (NMD), as well as in natural concentrated manganese dioxide obtained by said process.

2. Description of the Related Art

Natural manganese dioxide (NMD) is frequently used in the manufacture of electrochemical batteries. However, NMD normally contains a very high content of deleterious material, such as copper, nickel, cobalt, iron, aluminum, potassium, and the like, which is highly undesirable to manufacturers of such electrochemical batteries. The deleterious material, mainly the heavy metals, drastically reduces the discharging performance of the electrochemical batteries, while significantly increasing the corrosion thereof.

The process of hydrochloric acid (HCl) leaching of manganese ore has been described in several documents, especially in documents published in the late 1960's and early 1970's, when a large surplus of HCl derived from polyvinyl chloride (PVC) processing was available. Such leaching processes were based on the manganese ore being treated with an HCl solution under certain reaction conditions, especially temperature and HCl concentration. Examples of patents, which disclose such process are AU Patent 435 309, U.S. Pat. No. 3,437,345, published Application DE 2 164 799, U.S. Pat. No. 3,770,868, and U.S. Pat. No. 4,872,909. Other references similarly processes for leaching of manganese dioxide, such as "A New Process for the Production of Synthetic Battery grade Manganese Dioxide", National Chemical Engineering Conference, Surfers Paradise, Queensland, (1974). All such references, which represent the state of the art processes for the leaching of manganese dioxide, denote that the interesting phase of such process is the liquid i.e., the leaching phase. Therefore, the concentrate or solid residue of non-leached manganese dioxide in such process has a high concentration of deleterious material and, as a consequence, a low concentration of $MnO_2$, which, as mentioned above, is highly undesirable. There is no known process for the leaching of NMD ore which supplies, in industrial quantities, a concentrate of manganese dioxide having acceptable levels of deleterious material and which retains its original crystalline structure.

OBJECTS OF THE INVENTION

Therefore, the first object of this invention is to provide a process for the extraction and elimination of deleterious material from the NMD ore, performed in a convenient way and which eliminates the drawbacks and inconveniences of the prior technique.

Another object of this invention is to provide a process for the extraction and elimination of deleterious material, such as Cu, Ni, Co, Fe, Al, K and the like from NMD.

Another object of this invention is to provide a process to obtain a concentrate of NMD with a low level of deleterious material and, as a consequence, a high level of manganese dioxide, with minimum dissolution of the manganese dioxide, to retain the original crystalline structure, which is highly electroactive in electrochemical batteries.

Still another object of this invention is to provide a concentrate of manganese dioxide having a content of deleterious material which is so low that it may be highly desired by the manufacturers of electrochemical batteries.

Another object of this invention is to provide a concentrate of manganese dioxide which reduces the amount of corrosion in electrochemical batteries.

SUMMARY OF THE INVENTION

Following a first embodiment this invention includes, basically, the following stages:

a) feeding a reactor with an HCl and water mixture having an HCl concentration within the range from about 9% to 25% w/w while stirring and heating;

b) maintaining the temperature of the mixture in the reactor at about 80 to 95° C.;

c) feeding reactor with an amount of crushed NMD ore, such to provide a concentration of the reaction pulp from about 10% to 40%, depending upon the HCl concentration; and d) leaching to produce a leaching reaction of the NMD ore with HCl, for a period of about 10 to 60 minutes.

Following a second embodiment of this invention, through the above-described process, a concentrate of manganese dioxide is obtained, in which the $MnO_2$ content ranges from about to 85% to 95%.

DETAILED DESCRIPTION OF THE INVENTION

Following the terms of this invention, exploratory leaching tests were performed with NMD ore using HCl, to check for the existence of preferred solubility levels of deleterious materials, such as Cu, Ni, Co, Fe, Al, K and the like, relative to the original $MnO_2$. The tests considered variable values such as temperature, HCl concentration, reaction time and pulp density. In the tests, all such parameters were found to be of importance.

The preferred solubilization of the different deleterious components in the original $MnO_2$ was determined to be as of equal importance, considering that the concentration of the mineral by the leaching process is determined by the solubility of the impurities, and not the mineral ore. In this case, the mineral ore is $MnO_2$, in the form of "nsutita".

With the statistical results on hand, optimization tests were programmed. In this phase of the development, the effect performed by four independent variable values was checked: HCl concentration, temperature, leaching time and pulp density, which change at the same time, in respect to the dependent variable values, $MnO_2$ recovery, $MnO_2$ content and the content of deleterious materials. Surprisingly, it was noticed that the effects provided by the different independent variables, HCl concentration, temperature, leaching time and pulp density in respect to the dependent variables, recovery of $MnO_2$, content of $MnO_2$ and the content of deleterious materials, are important and highly beneficial in terms of final purity of the concentrate of manganese dioxide. In the process of this invention, the concentrate is the undissolved ore, with the leaching liquor being kept for future treatment. The importance of HCl concentration and of temperature in respect of the other variables became especially clear. It was shown, as an example, that the minimum HCl concentration should not be less than about 9% w/w. It was shown further that the minimum reaction temperature may not be lower than about 80° C. nor higher than about 95° C. It was noticed that if the reaction temperature is less than about 80° C., the process becomes uneconomical and that if the temperature is higher than about 95° C., it becomes too difficult to use HCl, due to its vapor pressure and oxidizing power.

Therefore, following the terms of this invention, a process is established for the extraction and elimination of deleterious material from the original $MnO_2$, such as Cu, Ni, Co, Fe, Al, K and the like, by the preferential solubility thereof in an HCl solution which ranges from about 9% to 25% w/w in a reactor. The quantity of NMD ore/quantity of HCl rate is such that a pulp should be obtained with a density from about 10% to 40%. The density of the pulp is determined by the concentration of HCl used in the solution. The pulp is then reacted for about 10 to 60 minutes by leaching at a temperature of about 80° C. to 95° C. The reaction time is determined by the extraction level of the deleterious material and by the desired recovery of $MnO_2$. One skilled in the art will know how to easily select the conditions under which the reaction will be performed, based upon the expected result. After the reaction, the resulting pulp is filtered and the resulting cake, which is the concentrate of manganese dioxide, is taken for drying and the filtrate, which is the hydrochloric acid liquor, is recycled to the beginning of the process.

The successive reutilization of the hydrochloric acid liquor increases the concentration of heavy metals, which is fundamental for its later extraction by chemical and/or electrochemical means. Besides, the process results in a higher solubility of the heavy metals relative to $MnO_2$. However, for each cycle, additional of HCl solution is added, in order to keep the concentration at an adequate level of the leaching solution. It should be noted that the HCl solution need not contain hydrogen peroxide as disclosed in prior art processes.

The mechanical means used are those normally used in the industry for the extraction and treatment of minerals, and may be selected and dimensioned by a technician expert in the matter.

By the process of this invention, concentrates with an $MnO_2$ recovery in the range from about 70% to 90% were obtained, with the chemical compositions as per the table below:

| | $MnO_2$ (%) | Mn (%) | Fe (%) | Al (%) | K (%) | Cu (ppm) | Ni (ppm) | Co (ppm) |
|---|---|---|---|---|---|---|---|---|
| Before | 80–82 | 53–54 | 2–3 | 2–3 | 1–2 | 280–300 | 600–700 | 150–200 |
| After | 87–92 | 56–58 | 0.6–1.0 | 0.8–1.0 | 0.4–0.5 | 140–160 | 200–400 | 70–90 |

The extraction and elimination of deleterious material from the NMD ore, as per this invention, allow for the above concentrates of manganese dioxide to be obtained. The advantages of which, besides those already described above, may be summarized as follows:

a) possibility of use of the concentrate of manganese dioxide in the manufacture of mercury free electrochemical batteries which are desired all over the world due to environmental problems caused by mercury; and b) by increasing the $MnO_2$ content, it is possible to increase the durability of the electrochemical batteries.

The other extraction products have important industrial and commercial demand, such as $MnCl_2$, from which it is possible to obtain $MnCO_3$ or EMD, besides the additives for fuels, animal feed and fertilizers, Ni, Cu and Co are metals of high industrial value.

This invention shall now be described referring to the example below, which shows one of the possible embodiments of the invention, and which does not have any limitative characteristics in respect to the scope of this description.

EXAMPLE 1

To one liter of 14% w/w HCl solution, stirred and heated to 90° C., 250 g of manganese ore (NMD) of the "nsutita" type are added, the chemical composition of which is as follows:

| $MnO_2$ (%) | Mn (%) | Fe (%) | Al (%) | K (%) | Cu (ppm) | Ni (ppm) | Co (ppm) |
|---|---|---|---|---|---|---|---|
| 80 | 53 | 3.0 | 2.0 | 1.0 | 300 | 700 | 200 |

After adding the NMD, the components are left to react for about 40 minutes, while maintaining the temperature.

After the reaction is completed, the reacted pulp is taken out and filtered on a porous plate. The recovered product, i.e., the concentrate of manganese dioxide, is washed with water and dried at temperatures up to about 60° C. The recovery in mass was 72% and the composition of the concentrate was as follows:

| $MnO_2$ (%) | Mn (%) | Fe (%) | Al (%) | K (%) | Cu (ppm) | Ni (ppm) | Co (ppm) |
|---|---|---|---|---|---|---|---|
| 89 | 58 | 0.8 | 1.0 | 0.4 | 150 | 300 | 70 |

X-ray diffraction analysis showed that the concentrate maintains the crystalline structure of the "nsutita" (y—$MnO_2$).

The so obtained concentrate was submitted to several types of discharge tests in electrochemical batteries, and showed a 20% better performance than the ore before the treatment, providing a 50% reduction of corrosion in said batteries.

While the present invention has been particularly described, it will be appreciated by those of ordinary skill in the art that various changes and modifications may be made without departing from the spirit and scope of the present invention. It is intended that the appended claims be interpreted as including the embodiments described herein, the alternatives mentioned above and all equivalent thereto.

What is claimed is:

1. A process for extracting and eliminating deleterious material from natural manganese dioxide (NMD) comprising:

feeding a reactor with a solution consisting of HCl and water, heating said solution with stirring to a reaction temperature ranging from about 80° C. to 95° C. and maintaining the HCl concentration in said solution within a range of about 9% to 25% w/w;

maintaining the temperature of said HCl solution in said reactor at a temperature of from about 80° C. to 95° C.;

feeding said reactor containing said HCl solution with crushed NMD ore to provide a reaction pulp concentration of from about 10% to 40%;

leaching said reaction pulp with said HCl solution for a period of about 10 to 60 minutes;

filtering the contents of said reactor to recover the concentrate of manganese dioxide ($MnO_2$); and washing and drying the recovered concentrate of $MnO_2$.

2. The process of claim 1, wherein said deleterious material is Cu, Ni, Co, Fe, Al or K.

3. The process of claim 1, wherein said HCl and water solution is recycled to increase the concentration and solubility levels of Fe and heavy metals in respect to solubility levels of $MnO_2$ and Mn.

4. The process of claim 1, wherein the recovered concentrate of $MnO_2$ is dried at a temperature of about 60° C.

5. The process of claim 1, wherein the recovery of said $MnO_2$ is from about 70% to 90%.

6. The process of claim 1, wherein said HCl concentration is about 14% w/w, the reaction temperature is about 90° C., the reaction time is about 40 minutes, and the recovery of $MnO_2$ under such conditions is about 72%.

7. The process of claim 1 wherein said HCl concentration is about 14% w/w, the reaction temperature is about 90° C., the reaction time is about 40 minutes, and the recovery of $MnO_2$ under such conditions is about 72%.

* * * * *